United States Patent [19]

Groth

[11] Patent Number: 4,805,545

[45] Date of Patent: Feb. 21, 1989

[54] TEMPORARY STORAGE MAST SUPPORT

[76] Inventor: Jerry Groth, 2525 S. 162nd St., New Berlin, Wis. 53151

[21] Appl. No.: 53,878

[22] Filed: May 26, 1987

[51] Int. Cl.[4] ..... B63H 9/04

[52] U.S. Cl. ..... 114/90; 248/539

[58] Field of Search ..... 211/60.1; 248/511, 518–520, 248/534, 536, 538, 539; 224/42.45 R, 42.03 R, 42.07; 441/74; 114/39, 39.1, 39.2, 89, 90

[56] References Cited

U.S. PATENT DOCUMENTS

| | | | |
|---|---|---|---|
| Re. 31,167 | 3/1983 | Schweitzer et al. | 114/39 |
| 2,594,158 | 4/1952 | Hannameyer | 211/119.01 |
| 2,784,848 | 3/1957 | Senne | 211/178 |
| 3,173,395 | 3/1965 | Laurent | 114/39 |
| 3,800,724 | 4/1974 | Tracy | 114/39 |
| 4,005,667 | 2/1977 | Staba | 114/283 |
| 4,206,847 | 6/1980 | Brink | 211/1.3 |
| 4,225,048 | 9/1980 | Hildreth | 211/1.3 |
| 4,478,164 | 10/1984 | Menear | 114/39 |
| 4,669,407 | 6/1987 | Cobb | 114/90 |
| 4,697,534 | 10/1987 | Kettlestrings | 114/90 |

FOREIGN PATENT DOCUMENTS

| | | | |
|---|---|---|---|
| 7803617 | 8/1987 | Fed. Rep. of Germany | 114/90 |

*Primary Examiner*—Joseph F. Peters, Jr.

*Assistant Examiner*—Clifford T. Bartz

*Attorney, Agent, or Firm*—Willis B. Swartwout, III

[57] ABSTRACT

A temporary mast support and storage structure for a detachable mast for a wind surfing board or the like having an attached sail and boom structure. The structure includes a first hollow, elongated cylindrical sleeve having a radially outwardly extending flange whereby the flange adapts the sleeve to be emplaced in sand or concrete and the flange being further adapted to be coupled with a vehicular mounted trailer hitch. A second hollow, elongated cylindrical sleeve having a radially outwardly extending flange is provided the radius of the cylinder of the second sleeve being lesser than the radius of the cylinder of the first sleeve such that the second sleeve fits within the first sleeve with the flange of the second sleeve overlying, at least in part the flange of the first sleeve. A plurality of stops on the surface of the flange of the first sleeve facing the flange of the second sleeve and a stop engaging projection on the surface of the flange of the second sleeve facing spacially outwardly such that the arcuate spacing of the stops limits the rotational movement of the second sleeve relative to the first sleeve by engaging the projection. The second sleeve being hollow receives the mast with sail and boom attached telescopingly therein.

3 Claims, 2 Drawing Sheets

TEMPORARY STORAGE MAST SUPPORT

BACKGROUND OF THE INVENTION

The present invention relates to a mast support structure and more particularly to a mast support structure for use in temporarily storing a mast with sail attached such as might be used in wind surfing.

Wind surfing boards and masts are generally constructed in such a fashion so as to have a board such as is generally in use in surfing to which a mast is detachably secured which has a sail. The sail is most often provided with a sleeve through which the mast fits. Also, the mast is provided with elliptical booms on both sides to which the surfer clings both to hold on and to steer or tack the board.

When the surfer decides to rest between sailings or to break for meals, the board is pulled up on shore and the mast sail and booms are of sufficient weight so that the structure "lays over" with the sail and boom on one side on the ground. If there are sharp rocks or shells, substantial damage can be done to the sail. As sails are very expensive, this is a very undesirable way of storing the structure on a temporary basis. The problem can become more severe if the mast, sail and boom are detached and placed on the ground separately, especially if there is a breeze to whip at the sail.

As most wind surfing is done by persons who convey the board and mast to the lake, river, or ocean by automobile, it is practicable to also convey to the location a means for temporarily storing and supporting the mast, sail and boom structure of the wind surfing equipment above set forth when it is detached from the board which will prevent injury to the mast, sail and boom.

SUMMARY OF THE INVENTION

The present invention is a temporary storing and mast supporting device for supporting a detachable mast with sail and boom members of the type generally in use for wind surfing boards when the mast, sail and boom as a unit have been detached temporarily from the board. The temporary storing and mast supporting device includes a first or outer, hollow cylindrical sleeve provided with an outwardly protruding flange at one end which may be adapted for attachment to an automobile trailer hitch or for substantial partial immersion in a bucket of sand or concrete or the like. A first detent is provided on the surface of the flange which faces upwardly. A second or inner, hollow cylindrical sleeve provided with an outwardly protruding flange at one end, the second sleeve adapted to fit telescopingly within the first sleeve and the outwardly facing surface of the flange of the second flange being a second detent such that when the second sleeve is inserted within the first sleeve the flanges overlap and the first and second detent members limit the relative rotational movement of the second sleeve within the first sleeve. The detachable mast with sail and boom members attached is placed telescopingly within the second sleeve.

It is an object of the present invention to provide a temporary storing and mast supporting device for a detachable mast with sail and boom members attached including a first storage member adapted to be fixedly emplaced against tilting and rotational movement and a second storage member receivable by the first storage member and adapted to receive the mast with sail and boom members attached.

It is still another object of the present invention to provide a device of the character described wherein the first storage member is adapted to receive telescopingly therewithin a second storage member adapted to receive therewithin a detachable mast with sail and boom members attached.

It is yet another object of the present invention to provide a device of the character described wherein the first and second storage members are provided with cooperating detent structure for limiting the rotational movement of the second storage member within the first storage member.

It should be noted that the structure described can be used as a support for a picnic table umbrella mast or other similar vertical objects.

The foregoing and other objects and advantages of the invention will appear from the following description. In the description, reference is made to the accompanying drawings which form a part hereof, and in which there is shown by way of illustration a preferred embodiment of the invention. Such embodiment does not necessarily represent the full scope of the invention, however, and reference is made therefore to the claims herein for interpreting the scope of the invention.

DESCRIPTION OF THE PREFERRED EMBODIMENT

Figure 1:
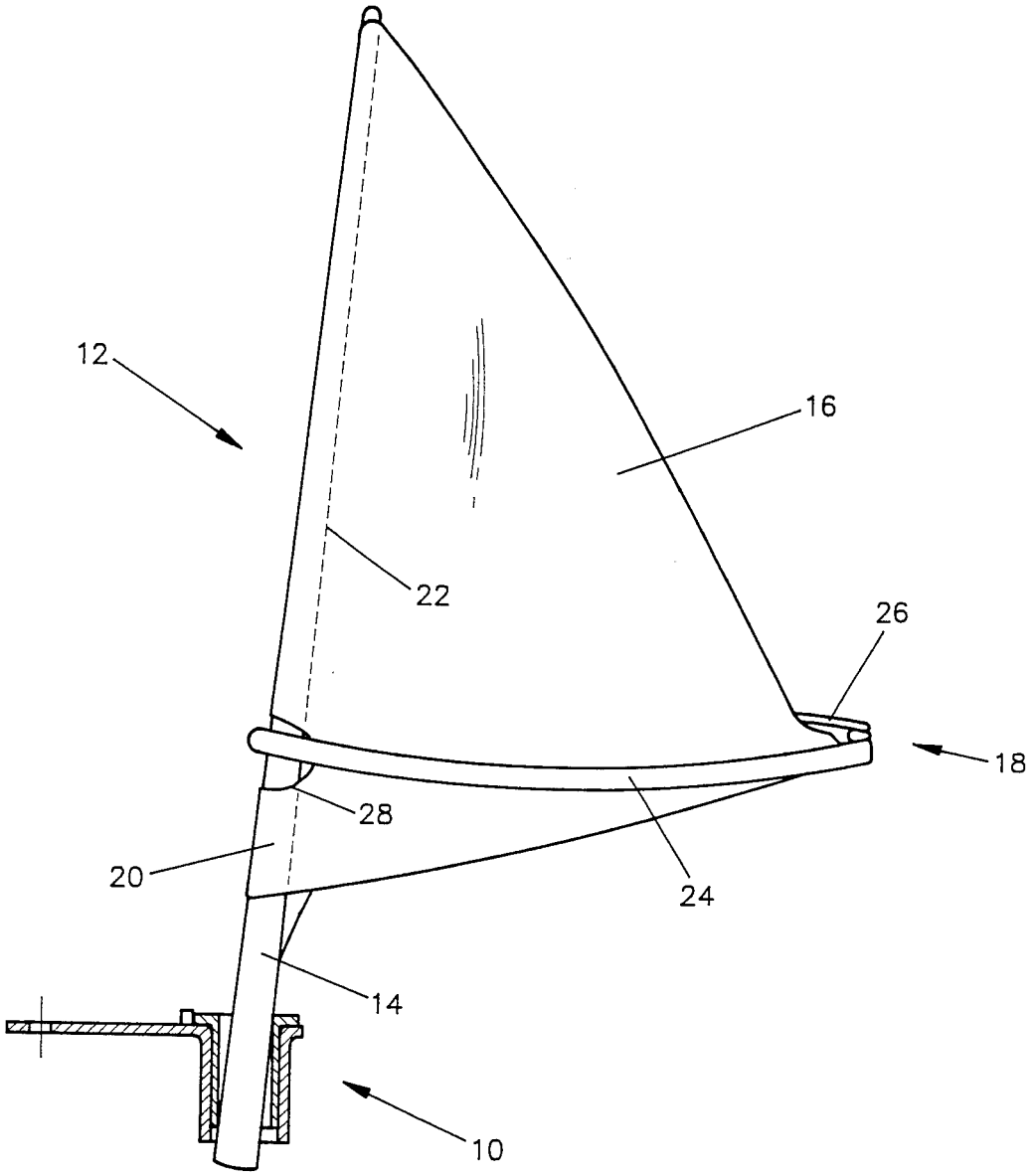
FIG. 1 is a view partially in vertical cross-section and partially in side elevation showing structure embodying the present invention.

Referring now to the drawings and more particularly to FIG. 1, a temporary mast storage and support device is disclosed generally identified by the numeral 10. Device 10 is shown in vertical cross-section as it would be used to temporarily support and store mast structure generally identified by the numeral 12. Mast structure 12 consists of a mast 14, a sail 16 and boom structure 18. Note that said 16 has a sleeve 20 created by seam 22 indicated in dotted line. Sleeve 20 fits about mast 14. Boom structure 18 consists of a left arcuate boom member 24 and a right arcuate boom member 26 relative to sail 16 coupled at one end to mast 14 and each other and coupled at the ends of boom 24 and 26 remote from mast 14 to each other. A suitable aperture 28 in sail 16 is provided to accommodate the attachment of booms 24 and 26 to each other and mast 14. The foregoing structure is generally of the type in use for detachable mast, sail and boom structure of the boards of wind surfing.

Figure 3:
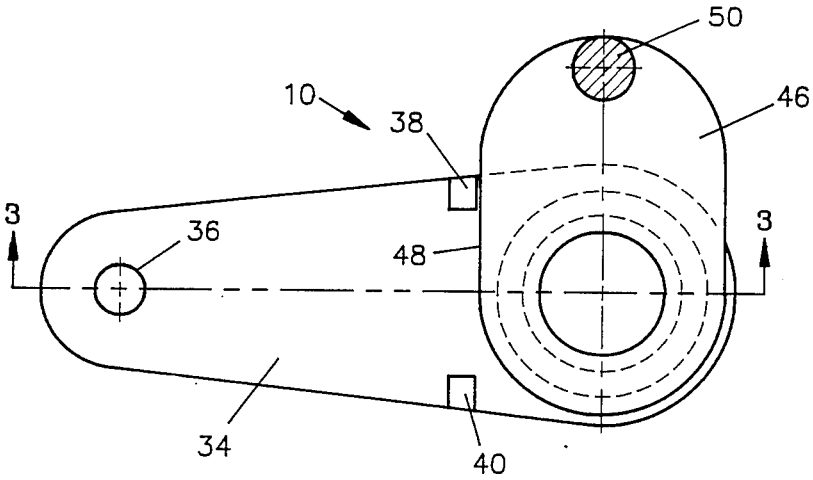
FIG. 3 is a top plan view of structure embodying the present invention.
Figure 4:
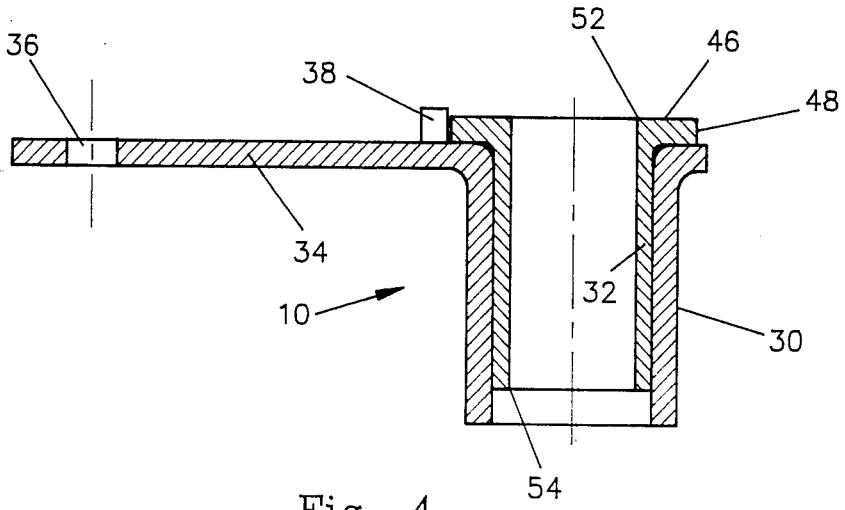
FIG. 4 is a vertical cross-sectional view of the structure shown in FIG. 3 taken along line 3—3 of FIG. 3.

Specific reference to FIGS. 3 and 4 of the drawings will disclose that temporary mast storage and support device 10 includes a first hollow elongated outer sleeve 30 and a second hollow elongated inner sleeve 32. Sleeve 30 is provided with a radially outwardly projecting first flange 34 at one end thereof. Flange 34 is provided with a flange aperture 36 for purposes which will be hereinafter explained and a pair of detents 38 and 40. Note that detents 38 and 40 are arcuately spaced relative to the vertical longitudinal centerline axis of sleeve 30.

It is essential to the optimum utility of device 10 that sleeve 30 be secure against tilting relative to its vertical longitudinal centerline axis and that sleeve 30 also be secure against rotational movement around its vertical longitudinal centerline axis.

Reference to FIGS. 3 and 4 will disclose one means of securing sleeve 30 against tilting and rotational movement. Aperture 36 is provided to accomplish this purpose by attaching flange 34 to a common vehicular trailer hitch. The threaded ball, nut and lock washer of such a hitch may be removed, aperture 36 aligned to register with a similar aperture (not shown) on the hitch structure and the threaded hitch ball inserted through the flange and hitch apertures and the spring type lock washer placed and the nut threadably coupled with the hitch ball threaded shank. As the nut is then drawn up tightly, it may be seen that flange 34 and thereby sleeve 30 are secured and against both tilting and rotational movement relative to the vertical longitudinal centerline axis of sleeve 30.

Figure 2:
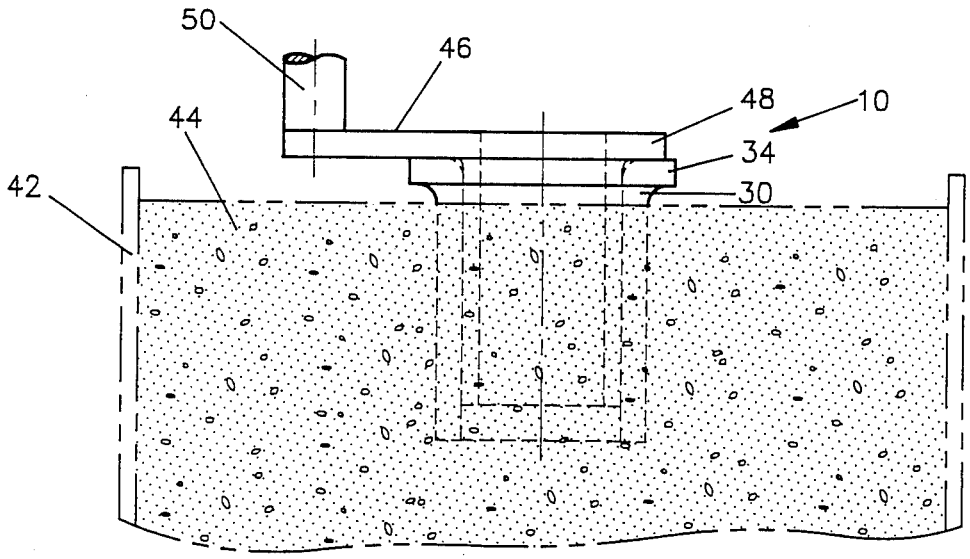
FIG. 2 is a vertical cross-sectional view of an alternate embodiment of the present invention.

A reference to FIG. 2 of the drawings will show the same accomplishment of objective by placing sleeve 30 in a container 42 of aggregate 44 such as concrete. When the concrete hardens the container 42 with the concrete provide a weighted bottom to secure sleeve 30 against tilting and at the same time sleeve 30 is secured in position against rotation about its vertical longitudinal centerline axis.

Referring primarily back to FIGS. 1 and 2 of the drawings, it should be easily seen that inner sleeve 32 has an exterior surface radius relative to its longitudinal centerline axis which is shorter than the interior surface radius of sleeve 30 relative to its longitudinal centerline axis. Sleeve 32 is provided with a radially outwardly projecting second flange 46 and one end of sleeve 32. Flange 46 is generally oval or elliptical in top plan and disposed eccentrically relative to sleeve 32 to provided a radially outwardly projecting surface 48. Flange 46 is further provided with a flange mast 50 at a point on flange 46 remote from the longitudinal centerline axis of sleeve 32 and having a longitudinal centerline of flange mast 50 in a generally parallel plane to that of the longitudinal centerline axis of sleeve 32.

Reference to FIGS. 2, 3 and 4 will disclose that inner sleeve 32 is telescopingly inserted within outer sleeve 30 such that the two sleeves 30 and 32 have the same vertical longitudinal centerline axis and such that flange 46 overlays flange 34 in the general area of sleeves 30 and 32. It may therefore be seen that sleeve 32 is limited in rotational movement about its vertical longitudinal centerline axis by the impingement of surface 48 of flange 46 with either detent 38 or 40. In the disclosed embodiment sleeve 32 and flange 46 are able to pivot approximately through an arc of 180°.

Reference back to FIG. 1 of the drawings will show that when a mast 14 is placed within sleeve 32 in a generally telescoping manner, the mast 14 is somewhat tilted relative to the vertical longitudinal centerline axis of sleeve 32 such that mast 14 frictionally engages the upper, inside cylinder margin 52 and the lower, inside cylinder margin 54 of sleeve 32.

Significantly, a mast 14 with sail 16 and boom structure 18 could catch the wind and if the wind were sufficiently strong, the mast 14 and/or sail 16 could rotate. Therefore, flange mast 50 is provided to prevent sufficient such motion so as to allow sail 16 and boom structure 18 to come in contact with structure of any kind sufficient to cause damage. The mast 14 is therefore placed in sleeve 32 such that sail 16 and boom structure 18 is to the windward of flange mast 50. If the sleeve 32 with mast structure 12 therein rotates because of the effect of the wind on sail 16 and the frictional engagement of mast 14 with margins 52 and 54 detents 38 and 40 will limit such rotational movement by abutting surface 46 thereby preventing the sail 16 and boom structure 18 from damage. The flange 34 and sleeve 30 being fixed against tilting as previously described prevents mast 14, sail 16 and boom structure 18 from falling over against the ground and sharp objects thereby being possibly damaged.

I claim:

1. A temporary mast storing and supporting device for a detachable mast including:

a. a hollow elongated cylindrical first sleeve with a first flange extending radially from one end of said first sleeve;

b. a hollow cylindrical second sleeve with a second flange extending radially from one end of said second sleeve, said second sleeve adapted to fit telescopingly within said first sleeve, said second sleeve having a smaller outside cylindrical radius than the inside cylindrical radius of said first sleeve and said first and second sleeves having a common longitudinal centerline axis;

c. wherein said first and second flanges are provided with detent structure on their upwardly and outwardly facing flange surfaces when said second flange is at least partially overlying said first flange limiting relative rotational movement of said second sleeve within said first sleeve.

2. The structure as set forth in claim 1, wherein said first flange is provided with an aperture remote from said first sleeve for coupling said first flange and sleeve to a vehicular ball hitch trailer mount.

3. The structure as set forth in claim 1, wherein said second flange is provided with a flange mast of sufficient length to engage boom structure attached to a removable sailing mast in said second sleeve protruding from the surface of said second flange remote from said first flange and at a location on said second flange remote from said second sleeve, when said second sleeve is telescopingly inserted in said first sleeve to intercept rotational movement of a sailing mast with sail and boom members attached placed in said second sleeve for temporary storage and support.

* * * * *